US006634780B1

(12) United States Patent
Stimson et al.

(10) Patent No.: US 6,634,780 B1
(45) **Date of Patent: *Oct. 21, 2003**

(54) ASPHALT PLANT HAVING CENTRALIZED MEDIA BURNER AND LOW FUGITIVE EMISSIONS

(75) Inventors: Martin L. Stimson, Center Point, IA (US); Joseph E. Musil, Ely, IA (US)

(73) Assignee: Cedarapids Inc., Cedar Rapids, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/645,679

(22) Filed: Aug. 24, 2000

Related U.S. Application Data

(63) Continuation-in-part of application No. 09/045,212, filed on Mar. 20, 1998, now Pat. No. 6,146,007.

(51) Int. Cl.[7] ..... B28C 5/46

(52) U.S. Cl. ..... 366/23; 366/25; 431/5; 431/7

(58) Field of Search ..... 366/4, 7, 10, 11, 366/12, 13, 22, 23, 24, 25; 431/5, 7, 170, 156, 198

(56) References Cited

U.S. PATENT DOCUMENTS

| | | | | |
|---|---|---|---|---|
| 1,727,340 | A | * | 9/1929 | Flory |
| 3,622,748 | A | | 11/1971 | Sellers |
| 3,791,923 | A | | 2/1974 | Bhan |
| 3,853,482 | A | | 12/1974 | Bhan |
| 3,880,143 | A | | 4/1975 | Hart et al. |
| 3,898,040 | A | | 8/1975 | Tabak |
| 4,096,588 | A | * | 6/1978 | Mendenhall |
| 4,229,109 | A | * | 10/1980 | Benson |
| 4,375,959 | A | * | 3/1983 | Powell |
| 4,477,250 | A | | 10/1984 | Brashears et al. |
| 4,495,154 | A | | 1/1985 | Christener et al. |
| 4,648,330 | A | | 3/1987 | Delebarre |
| 4,688,495 | A | | 8/1987 | Galloway |
| 4,702,892 | A | | 10/1987 | Betz |
| 4,714,593 | A | | 12/1987 | Naito et al. |
| 4,823,711 | A | | 4/1989 | Kroneberger et al. |
| 4,845,941 | A | | 7/1989 | Paul |
| 4,867,949 | A | | 9/1989 | Betz |
| 5,165,884 | A | | 11/1992 | Martin et al. |
| 5,199,961 | A | | 4/1993 | Ohsaki et al. |
| 5,201,839 | A | * | 4/1993 | Swisher, Jr. |
| 5,347,936 | A | | 9/1994 | Thorhuus |
| 5,376,340 | A | | 12/1994 | Bayer et al. |
| 5,470,360 | A | | 11/1995 | Sederquist |
| 5,478,530 | A | * | 12/1995 | Swanson |

(List continued on next page.)

OTHER PUBLICATIONS

"Flameless Thermal Oxidizers for VOC Control", ©1992, Thermatrix Inc., 3 pages.

Binder, William D., Martin, Richard J., "The Destruction of Air Toxic Emissions by Flameless Thermal Oxidation" ©1993, Thermatrix Inc., 18 pages.

*Primary Examiner*—Charles E. Cooley
*Assistant Examiner*—David Sorkin
(74) *Attorney, Agent, or Firm*—Marshall, Gerstein & Borun LLP

(57) ABSTRACT

An asphalt plant includes a plurality of asphalt processing components including a first set of components producing volatile emissions and a second set of components requiring process heat. A separate central burner assembly is adapted to supply heat energy in the form of heated gas to satisfy the process heat requirements of the second set of components. A first duct system is provided which includes a fan and which is adapted to capture a portion of the volatile emissions produced by the first set of components and to convey the captured emissions into the central burner assembly for mitigation. A second duct system is provided and includes a fan and is adapted to convey heated gas from the central burner assembly to the second set of components.

26 Claims, 5 Drawing Sheets

U.S. PATENT DOCUMENTS 5,508,007 A 4/1996 Vidal et al.
5,601,790 A 2/1997 Stilger et al.
5,620,249 A 4/1997 Musil et al.
5,634,712 A 6/1997 Musil
5,635,139 A 6/1997 Holst et al.
5,810,471 A 9/1998 Nath et al.
5,902,040 A 5/1999 Catlett
5,989,010 A 11/1999 Martin et al.
6,146,007 A * 11/2000 Stimson et al.

* cited by examiner

ASPHALT PLANT HAVING CENTRALIZED MEDIA BURNER AND LOW FUGITIVE EMISSIONS

This application is a Continuation-in-Part of U.S. application Ser. No. 09/045,212, filed Mar. 20, 1998 now U.S. Pat. No. 6,146,007, the entire disclosure of which is incorporated herein by reference.

FIELD OF THE INVENTION

The invention relates generally to asphalt plants. More specifically, the present invention relates to an asphalt plant which captures and mitigates fugitive emissions and which uses a centralized media burner to supply process heat energy to the various plant components.

BACKGROUND OF THE INVENTION

On asphalt plants it is desirable to have a variety of air pollution control measures. The asphalt making process, by its very nature of heating and processing the bituminous asphalt components, produces a considerable quantity of undesirable hydrocarbons (HC), carbon monoxide (CO), nitrogen oxides (NOx), particulate matter and other emissions which constitute the unfortunate signature plume of an asphalt plant, commonly referred to as "blue smoke." In addition to being a source of air pollution, asphalt plants are noisy and visually unappealing, owing to their network of open conveyors, hoppers, bins, blowers and other heating and material handling equipment. Accordingly, asphalt plants in general are regarded as quite a nuisance, especially in and around residential areas.

The typical asphalt plant has high energy requirements. The drum dryer/mixer typically includes a gas burner to dry the aggregate material and to heat the mixing zone to foster adequate mixing of the aggregate with the liquid asphalt. The asphalt material contained in the asphalt storage tanks must be constantly heated to maintain the asphalt cement in its liquid state, and thus another gas burner or similar heating system is required in order to constantly heat the storage tanks. Thus, burner emission are created at both the asphalt storage tanks and at the drum dryer/mixer.

Moreover, the volatile components of the heated asphalt cement as well as the finished asphalt create a certain amount of fugitive emissions as the asphalt components and the finished asphalt are stored, mixed, and transported through the plant. Furthermore, the asphalt cement storage tanks and the asphalt storage silos are usually vented in order to prevent undue pressure build up, especially on hot days, which further complicates the fugitive emission problem. Additional fugitive emissions are created when the finished asphalt material is loaded onto trucks for transport to a job site.

One approach to alleviating the fugitive emission problem has been to enclose portions or all of the plant in order to minimize the amount of leakage from the ductwork and conveyors in the plant. Such an approach, an example of which is described more fully in U.S. Pat. No. 5,620,249, does not provide an improved mitigation system and is typically best suited for applications in which the plant can be made very compact, which is not always feasible.

Attempts have also been made to apply flameless media burner technology to asphalt plants. Media burner technology uses a bed or matrix of ceramic materials which act as a flame arrestor, thereby controlling the rate and temperature of the combustion process. Externally mixed fuel is added to the media burner, which is pre-heated until a self-sustaining combustion is initiated. Ideally, a very efficient centralized media burner should be able to supply heat to the various process components, so that the maximum amount of energy is extracted from the consumed fuel. Unfortunately, existing media burner technology has proven unsatisfactory for asphalt processing plants. The externally mixed fuel components have proven to be too explosive for safe, everyday applications.

Accordingly, there exists a continuing need for an improved asphalt plants.

SUMMARY OF THE INVENTION

According to a first aspect of the invention, an asphalt plant includes a plurality of asphalt processing components, with the plurality of processing components including a first set of components producing volatile emission and a second set of components requiring process heat. A central burner assembly is disposed separately from each of the plurality of processing components, with the central burner assembly being adapted to supply heat energy in the form of heated gas to satisfy the process heat requirements of the second component set. A first duct system is in flow communication with the first component set and the central burner assembly, with the first duct system including a fan and being adapted to capture a portion of the volatile emissions produced by the first component set and to convey the captured emissions into the central burner assembly for mitigation. A second duct system is in flow communication with each of the components in the second component set and the central burner assembly, with the second duct system including a fan and being adapted to convey heated gas from the central burner assembly to the second component set.

In further accordance with a preferred embodiment, the first set of components may include an asphalt cement storage tank, an asphalt storage silo, a drum dryer/mixer having a mixing zone, and/or a truck loading area having a substantially sealed enclosure. At least one component of the first set of components may include an enclosure connected to the first duct system.

The central burner assembly may include an air inlet plenum, with the first duct system being connected to the air inlet plenum. Further, the second component set may include a rotary drum dryer/mixer, and the second duct system may include an insulated portion for conveying heat to the drum dryer/mixer. The asphalt plant may include a cement storage tank, with each of the storage tank and the central burner assembly including a heat exchange unit, with the heat exchange units being adapted to scavenge heat from the central burner assembly and convey the heat to the storage tank.

Preferably, the central burner assembly comprises a media burner having an enclosed combustion chamber defined in part by a top wall, a bottom wall, and an interconnecting sidewall. A portion of the combustion chamber preferably contains a matrix of ceramic members. The media burner preferably includes a fuel delivery system, with the internal delivery system being adjustable to permit the fuel to be injected at different locations within the media burner.

Still preferably, the first duct system may be connected to an air plenum for delivering captured fugitive emissions to the media burner, and an air valve may be provided for controlling the flow of air from the air plenum to the combustion chamber. The air valve may include a baffle slidably mounted adjacent an air inlet opening in the bottom wall, with the baffle being moveable between an open position removed from the air inlet opening and a closed position covering the air inlet opening.

In accordance with another aspect of the invention, a central media burner is provided for providing process heat in the form of heated gas to a selected set of asphalt processing components, with the central media burner being separate from each of the processing components. The central media burner comprises an enclosed combustion chamber defined in part by a top wall, a bottom wall, and an interconnecting sidewall. A portion of the combustion chamber contains a matrix of ceramic members, with at least one of the walls defining a gas outlet. The combustion chamber is adapted to supply thermal energy in the form of heated gas. An adjustable internal fuel delivery system delivers fuel to a selected location in the combustion chamber portion, and an air inlet plenum delivers combustion air to the combustion chamber. A duct system communicates the heated gas from the gas outlet to the selected set of processing components, whereby the heated gas is supplied through the duct system to each of the processing components to satisfy the process heat requirements thereof.

In accordance with yet another aspect of the invention, an asphalt plant comprises a plurality of asphalt processing components, with a first set of components producing volatile emissions, and a second set of components requiring process heat energy. A central media burner produces process heat energy in the form of heated gases, with the media burner having an enclosed combustion chamber defined in part by a top wall, a bottom wall, and an interconnecting sidewall, with a portion of the combustion chamber containing a matrix of flame arresting ceramic members. The central media burner, which is separate from each of the plurality of asphalt processing components, also includes an inlet and an outlet. A fuel delivery system is provided to deliver combustion fuel directly to the combustion chamber. A first duct system including a fan is in flow communication with the first component set and the central media burner inlet, and captures a portion of the volatile emissions produced by the first component set and conveys the captured emissions to the inlet of the central media burner for mitigation. A second duct system includes a fan and is in flow communication with the second component set and the central media burner outlet, and conveys heat energy from the outlet of the central media burner to the second component set.

In accordance with a still further aspect of the invention, an asphalt plant comprises a drum dryer/mixer requiring heat energy and producing volatile emissions, a flameless media burner assembly, a first duct system and a second duct system. The media burner assembly is remote from the drum dryer/mixer, with the media burner assembly having an enclosed combustion chamber and a fuel delivery system extending into the combustion chamber. A portion of the combustion chamber houses a matrix of ceramic members, and the fuel delivery system has a fuel port to convey fuel to the combustion chamber portion. The first duct system is in flow communication with the drum dryer/mixer and the media burner assembly, with the first duct system including a fan and being adapted to capture a portion of the volatile emissions produced by the drum dryer/mixer and to convey the captured emissions into the media burner assembly for mitigation. The second duct system is in flow communication with the drum dryer/mixer and the media burner assembly, with the second duct system including a fan and being adapted to convey heat energy in the form of heated gas from the media burner assembly to the drum dryer/mixer.

In accordance with yet another aspect of the invention, an asphalt plant comprises an asphalt processing component that produces volatile emissions and that requires process heat, a flameless burner assembly, and a first and second duct system. The flameless burner assembly supplies heat energy to the processing component, with the flameless burner assembly being separate and spaced apart from the processing component. The first duct system is in flow communication with the processing component and the flameless burner assembly and captures at least a portion of the volatile emissions produced by the processing component and conveys the captured emissions into the flameless burner for mitigation. The second duct system is in communication with the processing component and the flameless burner assembly, and supplies heat energy from the flameless burner assembly to the second component set to thereby substantially satisfy the process heat requirements thereof.

These and other objects, features and advantages of the present invention will become readily apparent to those skilled in the art upon a reading of the following description and claims.

DETAILED DESCRIPTION

The following detailed description is not intended to limit the invention to the precise form or forms disclosed. The embodiments described in detail have been chosen in order to best explain the principles of the invention so that others skilled in the art may follow its teachings.

Figure 1:
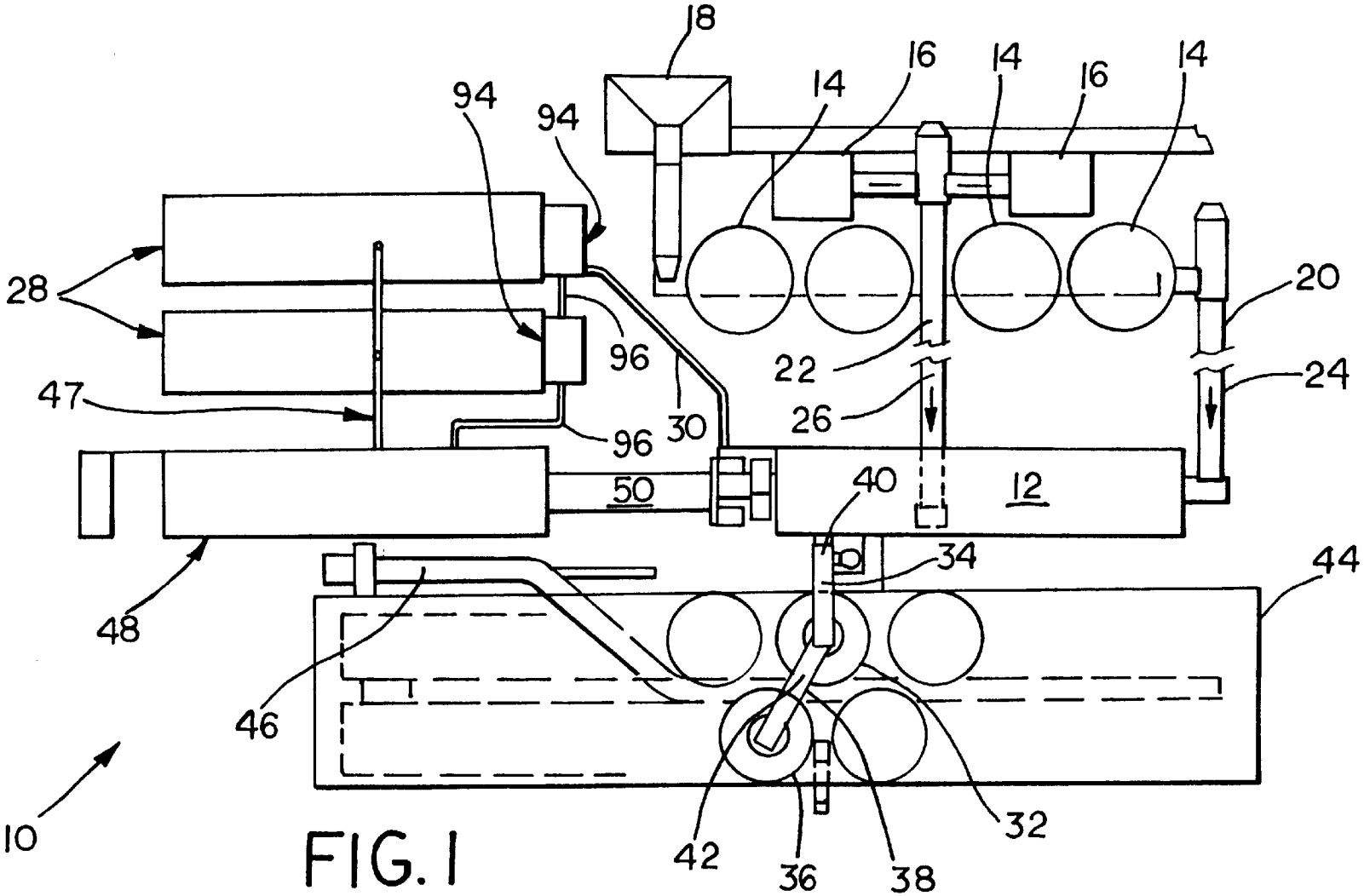
FIG. 1 is a top plan diagrammatic view of an asphalt plant incorporating the features of the present invention.
Figure 2:
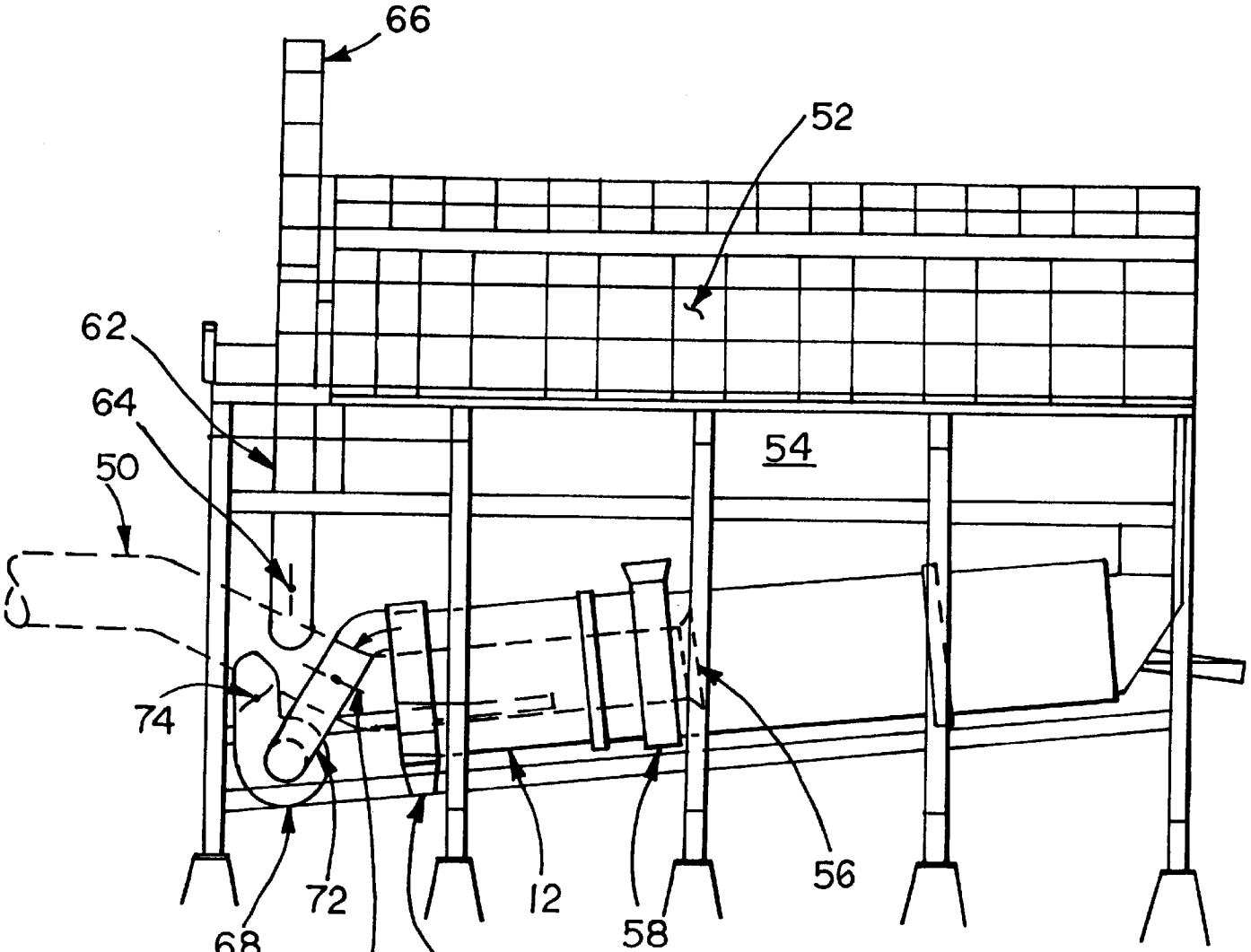
FIG. 2 is a fragmentary elevational view of the drum dryer/mixer and the baghouse filter illustrating the insulated duct from the media burner routed into the mixing zone of the drum dryer/mixer.

Referring now to the drawings, FIGS. 1 and 2 illustrate an asphalt plant incorporating features of the present invention and generally referred to by the reference numeral 10. The asphalt plant typically includes a variety of plant processing components, such as those components outlined in more detail in U.S. Pat. No. 5,620,249, the disclosure of which is incorporated herein by reference. Asphalt plant 10 typically includes a rotating drum dryer/mixer 12. The drum dryer/mixer 12 is preferably of the counterflow design, although a parallel flow drunk dryer/mixer could also be used. Asphalt plant 10 also typically includes a plurality of virgin aggregate silos 14, a recycled asphalt product (RAP) storage bin 16, and a virgin aggregate hopper 18. A conveyor 20 is provided to transport the virgin aggregate to the drum dryer/mixer 12, while a RAP conveyor 22 is provided to transport the RAP to the drum dryer/mixer 12. The conveyors 20, 22 may be slat conveyors or other conventional designs. Each conveyor 20, 22 is preferably enclosed by a duct 24, 26, respectively. One or more asphalt cement storage tanks 28 are provided which supply liquid asphalt to the drum dryer/mixer 12 via a feed line 30 as is well known in the art.

Finished hot mix asphalt produced in the drum dryer/mixer 12 is conveyed to a batcher silo 32 by a bucket conveyor 34, from where the asphalt is transferred to one or more loadout silos 36 by a conveyor 38. The bucket conveyor 34 and the conveyor 38 are each enclosed by a duct 40, 42, respectively. The loadout silos are preferably mounted over an enclosure 44 sized to receive a transport vehicle (not shown). Each of the drum dryer/mixer 12, the conveyors 20 22 [22, 24], 34, 38, and the silos 32 and 36 are likely to release volatile emissions, which are captured by a portion of the duct systems 24, 26, 40, 42 and the enclosure 44. The captured emissions are routed to a return duct 46, and then to a central burner 48 as outlined below. Another return duct 47 is provided which routes captured emissions from the storage tanks 28 to the central burner 48 as will be discussed in greater detail below.

The central burner 48 is preferably a media burner employing flameless combustion technology. A more complete explanation of flameless combustion technology can be found in U.S. Pat. No. 5,165,884, the disclosure of which is incorporated herein by reference. The return duct 46 is connected to the burner 48 for routing the captured emissions within the duct 46 to the burner 48 for mitigation as will be explained in greater detail below. Burner 48 includes an insulated duct 50 which routes heat energy to the drum dryer/mixer 12. Additional heat energy may be routed to other components as needed using additional ducts (not shown). Each of the above mentioned ducts preferably is insulated and includes one or more dampers for closing portions of the ducts during plant start up or as may otherwise be required.

As shown in FIG. 2, a filter or baghouse 52 is provided for capturing particulate emission from the drum dryer/mixer 12 in a manner well known in the art. An insulated duct 54 routes the exiting gas stream from the drum dryer/mixer 12 to the baghouse 52, and duct 54 is also connected to return duct 46 for routing emissions to the burner 48. The heat energy from the drum dryer/mixer 12, which has been routed through the insulated duct 50, enters the interior of the drum dryer/mixer 12 at an exit point 56.

Also as shown in FIG. 2, the drum dryer/mixer 12 preferably includes a collar 58 for introducing RAP into the drum dryer/mixer 12, a discharge hood 60 for routing finished hot mix asphalt out of the drum dryer/mixer 12, and an insulated duct 62 having a damper 64 that connects the drum dryer/mixer 12 to the stack 66 of the baghouse 54. A fan 68 in conjunction with a damper 70 controls the flow of gases from the mixing zone 73 of the drum dryer/mixer 12 to the insulated duct 50 via an insulated duct 72. Another damper 74 controls the flow of gases into the duct 50.

Figure 3:
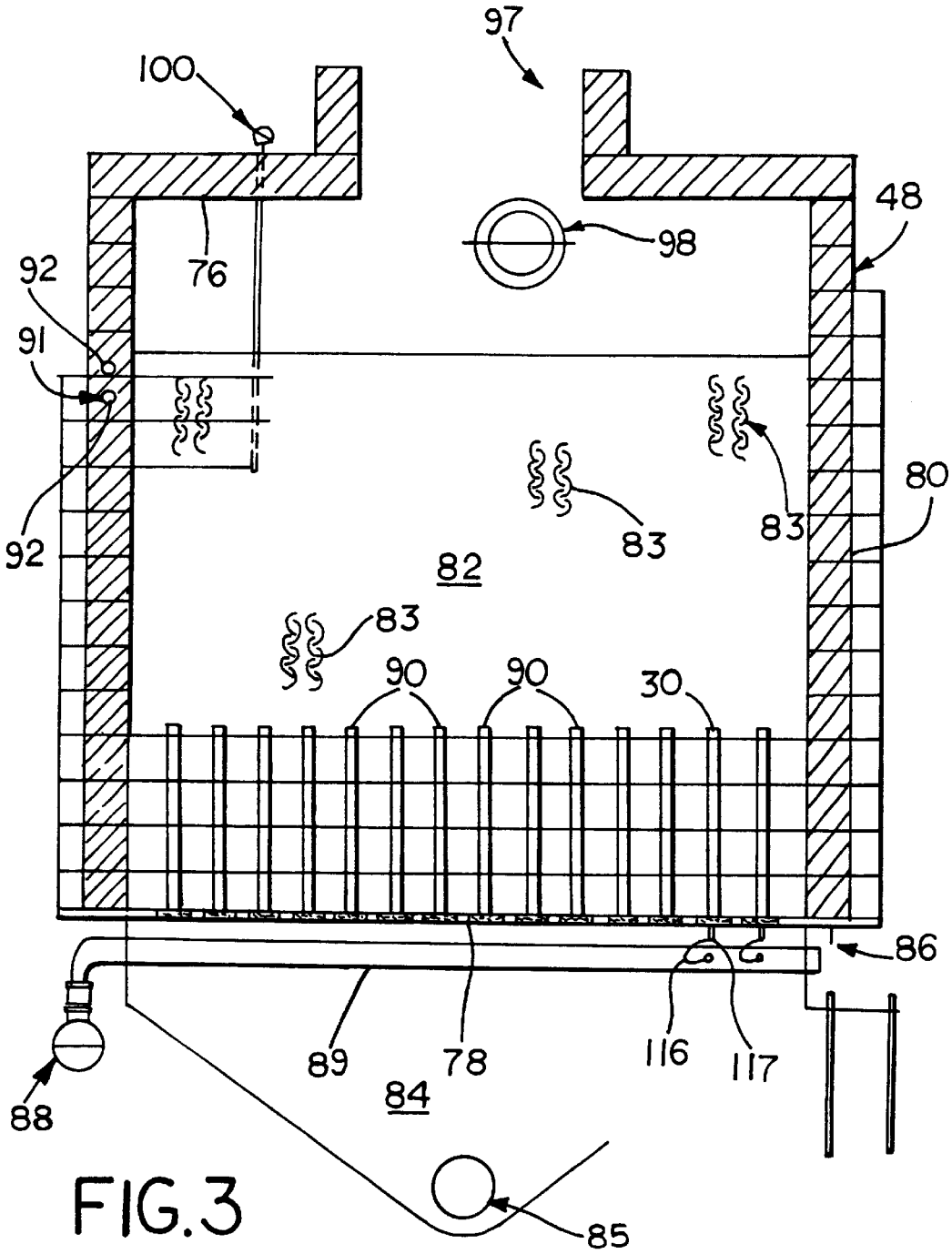
FIG. 3 is an enlarged elevational view in cross-section of the media burner having the internal add fuel injection system.

Referring now to FIG. 3, media burner 48 includes a top wall 76, a bottom wall 78, and continuous sidewalls 80 enclosing an internal combustion chamber 82. A plurality of ceramic members 83, such as saddles, balls, or other shapes, are disposed within the combustion chamber 82. The ceramic members 83 function to control the combustion process and will exhibit very high thermal inertia. The ceramic members may be any suitable shape, such as saddle shaped, round or spherically shaped, or "dog bone" shaped. An air inlet plenum 84, which is connected to outside air as well as to the return ducts 46 and 47, is provided for routing air and captured emissions to the combustion chamber via an air inlet valve assembly 86. The plenum 84 includes an auger 85 to permit periodic removal of the ceramic members 83, which may be released through the valve assembly 86 if needed.

A fuel delivery assembly 88 is provided for routing combustion fuel to the combustion chamber 82, and includes a fuel manifold 89 and a plurality of fuel injection lances or rods 90. The sidewall 80 of burner 48 includes a heat exchange unit 91 having a plurality of oil lines 92 which scavenge heat from the burner 48. The oil lines 92 route heated oil to a heat exchanger 94 on each of the asphalt cement storage tanks 28 via a feed line 96, which helps to maintain the asphalt within the storage tanks 28 in a liquid state. Burner 48 also includes a hot air outlet 97 connected to the insulated duct 50, a pre-heater 98 for heating the burner in preparation for start up, and a system of thermocouples 100.

Figure 4:
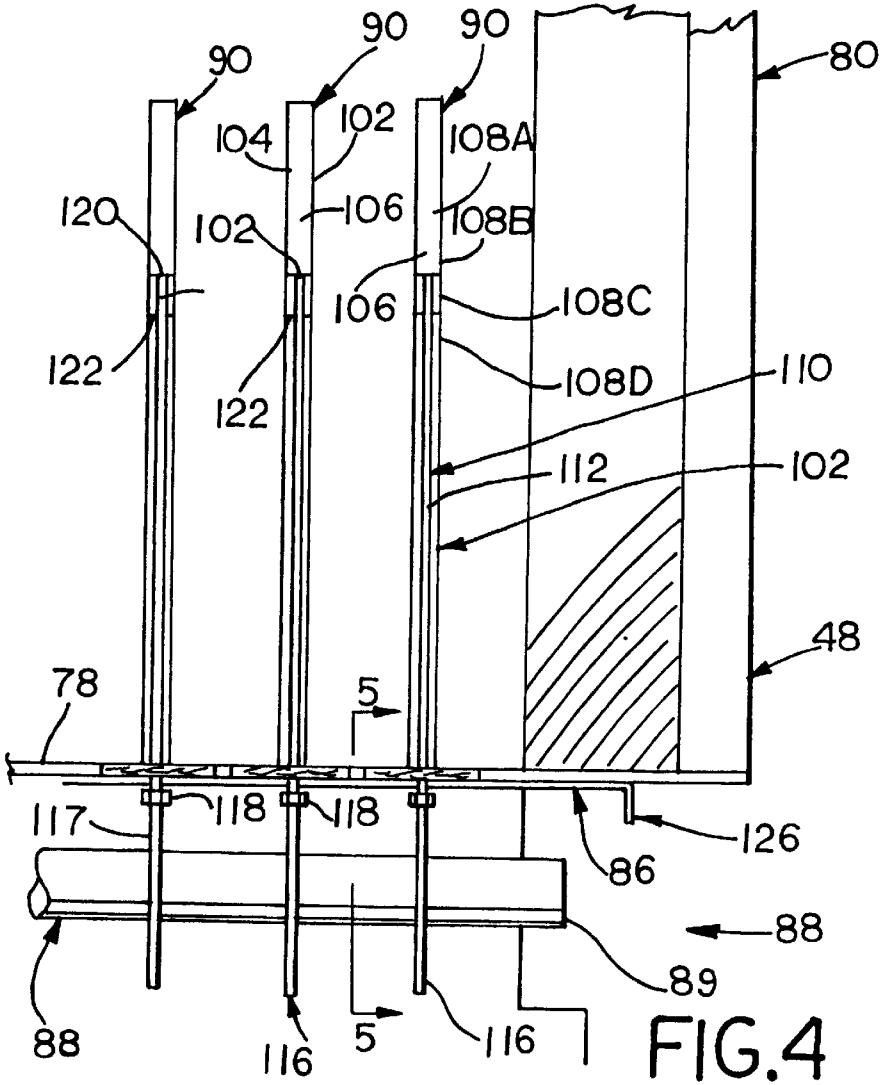
FIG. 4 is an enlarged fragmentary elevational view of the media burner internal fuel injection system.
Figure 5:
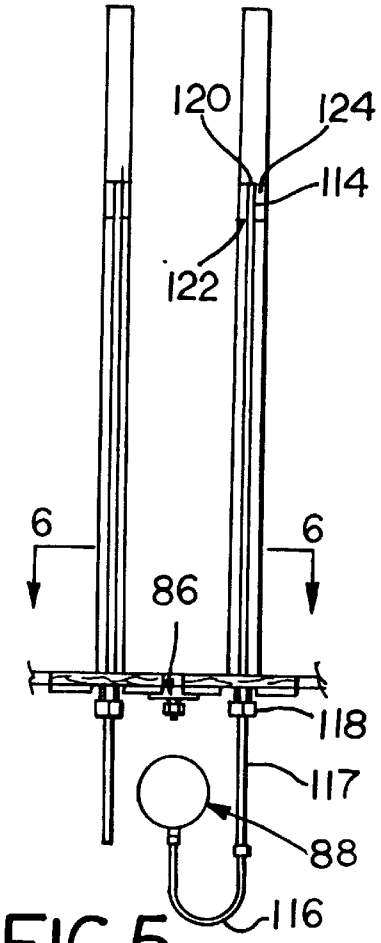
FIG. 5 is an enlarged fragmentary elevational view taken along lines 5—5 of FIG. 4.

As shown in FIGS. 3–5, the fuel rods 90 are arranged in a plurality of rows. Each fuel rod 90 includes an outer tube 102 having a sidewall 104 enclosing a chamber 106. A plurality of fuel ports, for example, 108*a*, 108*b*, 108*c*, . . . 108*n*, are provided in the sidewall 104. An inner conduit 110 is slidably disposed within each of the outer tubes 102, with each conduit 110 including a fuel flow passage 112 terminating in an orifice 114. The fuel passage 112 is connected to the fuel manifold 89 by a flexible hose 116 connected to an inlet end 117 of the conduit 110. Each inner conduit 110 includes an adjustable locking collar 118, which permits the inner conduit 110 to be adjusted relative to the outer tube 102. A pair of spaced apart seals 120, 122 are connected to an outlet end 124 of the inner conduit 110, with the orifice 114 being located between the seals 120, 122. Accordingly, fuel from the fuel manifold 88 is routed through the flexible hose 116, into the fuel passage 112, and into that the portion of the chamber 106 dictated by the present location of the inner conduit 110 (i.e., the present location of the seals 120, 122) relative to the outer tube 102. The fuel exits the chamber 106 via the closest adjacent fuel port 108*a*, 108*b*, 108*c*, or 108*n*, again depending on the position of the inner conduit 110 relative to the outer tube 102.

Figure 6:
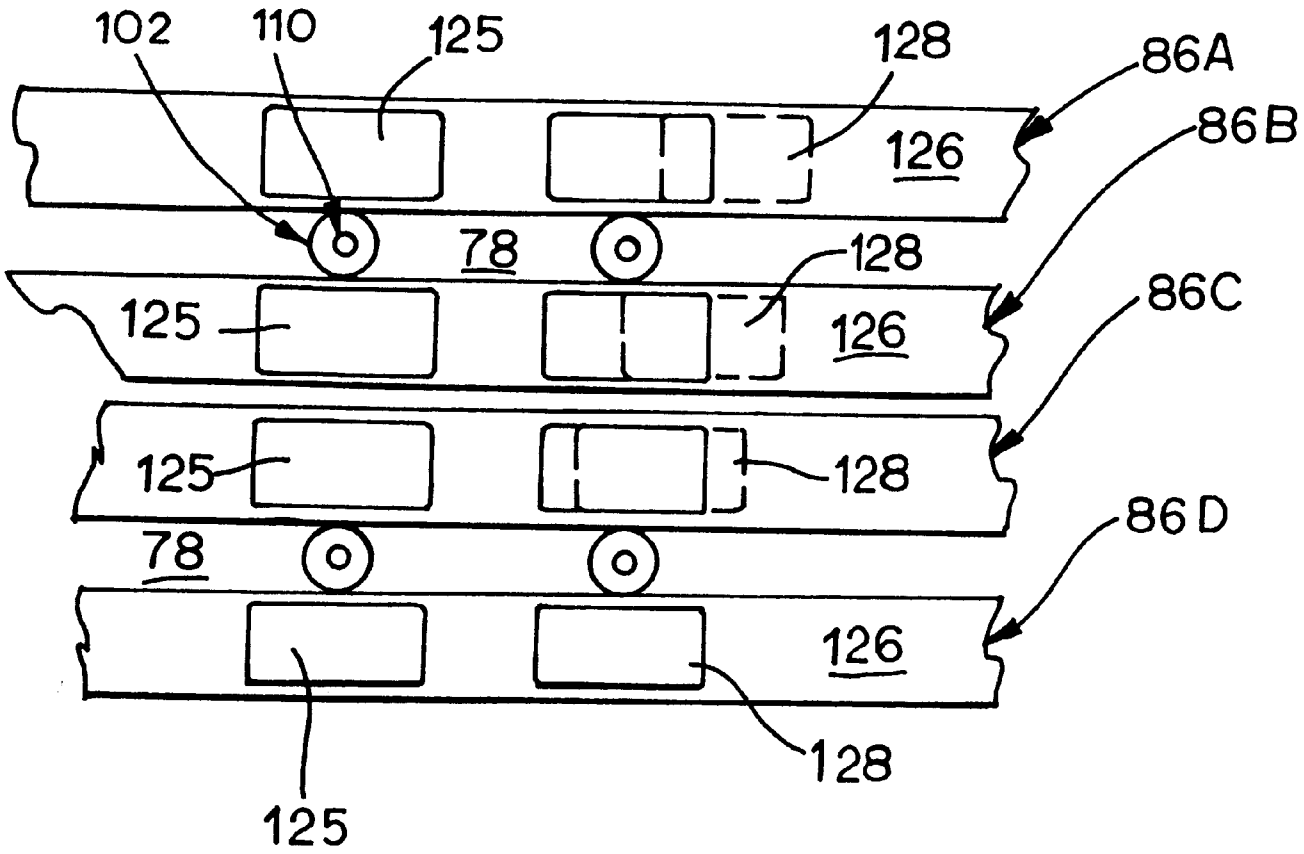
FIG. 6 is an enlarged fragmentary plan view taken along lines 6—6 of FIG. 5 illustrating the air valve assembly.

Referring now to FIGS. 4—6, the air valve assembly 86 includes a plurality of valves, for example 86*a*, 86*b*, 86*c*, and 86*d*, each of which is shown in a different position in FIG. 6. A plurality of spaced apart holes 125 are provided in the bottom wall 78 of the burner 48, which holes 125 communicate air from the air inlet plenum 84 to the combustion chamber 82. A baffle member 126 is slidably mounted to the bottom wall 78 and also includes a plurality of spaced apart holes 128, which are spaced to match the spacing of holes 125. Accordingly, the amount of air flowing through the holes 125 can be controlled by sliding the baffle member 126 back and forth on the bottom wall 78 having the holes 125. For example, the air flow can be maximized by sliding the baffle member 126 to the position of valve 86*a* at the top of FIG. 6, or minimized by sliding the baffle member 126 to the position of valve 86*d* at the bottom of FIG. 6, with valves 86*b* and 86*c* being shown in intermediate positions.

Although certain exemplary embodiments constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed:

1. An asphalt plant, comprising:

a plurality of processing components including a drum dryer/mixer, an asphalt cement storage tank, and a silo for storage of finished hot mix asphalt;

a central burner assembly disposed separately from the plurality of processing components;

a duct system adapted to convey volatile emissions generated by any one of the plurality of processing components to the central burner assembly; and a plurality of ducts adapted to convey heat energy from the central burner assembly to the asphalt cement storage tank and to the drum dryer/mixer.

2. The asphalt plant of claim 1, including a truck loading area, the truck loading area including a substantially sealed enclosure, the enclosure in flow communication to convey volatile emissions from the enclosure to the central burner assembly.

3. The asphalt plant of claim 1, wherein at least one of the plurality of components includes an enclosure connected to the duct system.

4. The asphalt plant of claim 1, wherein the plurality of ducts includes an insulted portion.

5. The asphalt plant of claim 1, the asphalt cement storage tank including a heat exchange unit and the central burner assembly including a heat exchange unit, wherein the heat exchange unit of the central burner assembly transfers heat energy from the central burner assembly to a first duct of the plurality of ducts, and wherein the heat exchange unit of the asphalt cement storage tank transfers the heat energy from the first duct to the asphalt cement storage tank.

6. The asphalt plant of claim 5, the heat exchange unit of the asphalt storage tank, the heat exchange unit of the central burner assembly, and the first duct including a plurality of oil lines adapted to scavenge heat from the central burner assembly and convey the heat to the asphalt cement storage tank.

7. The asphalt plant of claim 1, wherein the central burner assembly comprises a media burner, the media burner having an enclosed combustion chamber defined in part by a top wall, a bottom wall, and an interconnecting sidewall, a portion of the combustion chamber containing a matrix of ceramic members.

8. The asphalt plant of claim 7, wherein the media burner includes a fuel delivery system.

9. The asphalt plant of claim 8, wherein the fuel delivery system is adjustable to permit the fuel to be injected at different locations within the media burner.

10. The asphalt plant of claim 7, including an air plenum for delivering combustion air to the combustion chamber.

11. The asphalt plant of claim 10, wherein the duct system is connected to the air plenum for delivering captured fugitive emissions to the media burner.

12. The asphalt plant of claim 10, including an air valve for controlling the flow of air from the air plenum to the combustion chamber.

13. The asphalt plant of claim 12, wherein the air valve includes a baffle slidably mounted adjacent an air inlet opening in the bottom wall, the baffle being moveable between an open position removed from the air inlet opening and a closed position covering the air inlet opening.

14. An asphalt plant comprising:

a plurality of processing components including a drum dryer/mixer, an asphalt cement storage tank, and a silo for storage of finished hot mix asphalt;

a central burner assembly disposed separately from the plurality of processing components;

first means for conveying volatile emissions from the drum dryer/mixer and at least one of the asphalt cement storage tank and the silo to the central burner assembly; and second means for conveying heat energy from the central burner assembly to drum dryer/mixer and the asphalt cement storage tank.

15. The asphalt plant of claim 14, including a truck loading area, the truck loading area including a substantially sealed enclosure, the enclosure being operatively coupled to the first means for conveying to convey volatile emissions from the enclosure to the central burner assembly.

16. The asphalt plant of claim 14, the asphalt cement storage tank including a heat exchange unit and the central burner assembly including a heat exchange unit, wherein the heat exchange unit of the central burner assembly and the heat exchange unit of the asphalt cement storage tank are operatively coupled to the second means for conveying to convey heat energy from the central burner assembly to the asphalt cement storage tank.

17. The asphalt plant of claim 16, the heat exchange unit of the asphalt storage tank, the heat exchange unit of the central burner assembly, and the second means for conveying including a plurality of oil lines adapted to scavenge heat from the central burner assembly and transfer the heat to the asphalt cement storage tank.

18. The asphalt plant of claim 14, wherein the central burner assembly comprises a media burner, the media burner having an enclosed combustion chamber defined in part by a top wall, a bottom wall, and an interconnecting sidewall, a portion of the combustion chamber containing a matrix of ceramic members.

19. The asphalt plant of claim 18, wherein the media burner includes a fuel delivery system.

20. The asphalt plant of claim 19, wherein the fuel delivery system is adjustable to permit the fuel to be injected at different locations within the media burner.

21. The asphalt plant of claim 18, including an air plenum for delivering combustion air to the combustion chamber.

22. The plant of claim 21, wherein the first means for conveying is operatively coupled to the air plenum for delivering captured fugitive emissions to the media burner.

23. The asphalt plant of claim 21, including an air valve for controlling the flow of air from the air plenum to the combustion chamber.

24. The asphalt plant of claim 23, wherein the air valve includes a baffle slidably mounted adjacent an air inlet opening in the bottom wall, the baffle being moveable between an open position removed from the air inlet opening and a closed position covering the air inlet opening.

25. An asphalt plant, comprising:

a plurality of asphalt processing components, a first set of the components producing volatile emissions and including a drum dryer/mixer and at least one of an asphalt storage silo and a liquid asphalt storage tank, a second set of the components requiring process heat energy and including the drum dryer/mixer and the asphalt storage tank;

a central media burner for producing process heat energy in the form of heated gases, the central media burner having an enclosed combustion chamber defined in part by a top wall, a bottom wall, and an interconnecting sidewall, a portion of the combustion chamber containing a matrix of flame arresting ceramic members, the central media burner including an inlet and an outlet, the central media burner being separate from each of the plurality of asphalt processing components;

a fuel delivery system adapted to deliver combustion fuel directly to the combustion chamber;

a duct system in flow communication with the first set of components and the central media burner inlet, the duct system adapted to capture a portion of the volatile emissions produced by the first set of components and convey the captured emissions to the inlet of the central media burner for mitigation; and a plurality of ducts adapted to convey heat energy from the central burner assembly to each of the second set of components.

26. The asphalt plant of claim 25, wherein the fuel delivery system is adjustable to permit the fuel to be injected at different locations within the media burner.

* * * * *

UNITED STATES PATENT AND TRADEMARK OFFICE

CERTIFICATE OF CORRECTION

PATENT NO. : 6,634,780 B1
DATED : October 21, 2003
INVENTOR(S) : Martin L. Stimson et al.

It is certified that error appears in the above-identified patent and that said Letters Patent is hereby corrected as shown below:

Column 7,
Line 13, delete “insulted” and insert instead -- insulated --.

Signed and Sealed this

Sixth Day of July, 2004

JON W. DUDAS
*Acting Director of the United States Patent and Trademark Office*